US006702426B2

(12) United States Patent
Yashima

(10) Patent No.: US 6,702,426 B2
(45) Date of Patent: Mar. 9, 2004

(54) IMAGE CORRECTION METHOD FOR INKJET RECORDING SYSTEM

(75) Inventor: Masataka Yashima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/288,513

(22) Filed: Nov. 6, 2002

(65) Prior Publication Data

US 2003/0085950 A1 May 8, 2003

(30) Foreign Application Priority Data

Nov. 6, 2001 (JP) ..... 2001-340613

(51) Int. Cl.[7] ..... B41J 2/21; B41J 29/393
(52) U.S. Cl. ..... 347/43; 347/19
(58) Field of Search ..... 347/19, 43, 14; 358/1.9, 504, 518

(56) References Cited

U.S. PATENT DOCUMENTS 4,959,711 A * 9/1990 Hung et al. ..... 358/523
6,033,054 A 3/2000 Takagi ..... 347/43
6,267,519 B1 * 7/2001 Otsuki et al. ..... 400/283

FOREIGN PATENT DOCUMENTS

EP 0 983 855 3/2000
EP 1 151 867 11/2001

* cited by examiner

*Primary Examiner*—Thinh Nguyen
(74) *Attorney, Agent, or Firm*—Fitzpatrick, Cella, Harper & Scinto

(57) ABSTRACT

A method for correcting image degradations due to non-ejecting nozzles or kink ejection of nozzles without reducing a recording rate for an inkjet recording apparatus for recording images at high speed employing a one-pass recording system, in which an image is completed by one time scanning of a recording head relative to a recording medium, such as an inkjet recording apparatus using a full-line type recording head. When corrected data during head shading correction and nonejection complementing in image processing exceed a maximum value capable of being recorded, complementing is controlled with a different color corresponding to data-amount which exceeds the maximum value.

6 Claims, 6 Drawing Sheets

IMAGE CORRECTION METHOD FOR INKJET RECORDING SYSTEM

BACKGROUND OF THE INVENTION

1. Field of the Invention

The present invention relates to an image correction method for correcting image defects due to ejection-amount nonuniformity, deviation in a landing position (kink), and nonejection, which are inherent characteristics in each recording head of an inkjet recording system, in which by ejecting ink, ink dots are formed on a recording medium so as to form an image thereon.

2. Description of the Related Art

As copying machines, information processing equipment such as word processors and computers, and communication equipment achieve increasing popularity, digital image-recording apparatus using inkjet recording heads have also gained widespread use and acceptance. Enhancements to image quality and color in information processing equipment have led to the need for corresponding enhancements to image quality and color in image forming apparatus.

Such a recording apparatus utilizes a recording head integrated with plural recording elements (also referred to as a multi-head) in which plural ink nozzles and ink paths are integrated in high density for miniaturizing and speeding up printing a pixel. Furthermore, for colorization, the apparatus generally has plural multi-heads corresponding to the respective colors of cyan, magenta, yellow, and black. Using this design, it is possible to output high quality images at both high speed and low cost. Another practical way to increase speed ever further is to use a one-pass high-speed method, in which the length of the multi-head is about the width of a recording medium.

In a transverse-feed printer for A-4 size paper, for example, the length of a multi-head is about 30 cm, and requires approximately 7000 nozzles to print 600 dots per inch (dpi). It is extremely difficult to manufacture a multi-head having such a large number of nozzles without defects in one or more of the nozzles. Accordingly, all the nozzles may not necessarily have the same performance. Furthermore, some nozzles may become nonejectors after being used. However, a recording head shading technique for correcting density nonuniformity due to ejection-amount nonuniformity and deviation in a landing position (kink), and a nonejecting-nozzle correction (nonejection complementary) technique for performing complementary processing for a nonejecting nozzle can enable a multi-head with defects to be used.

According to one recording head shading technique, the output density of every nozzle is measured and input-image data gets feedback from the measured result. For example, if the ejection amount of one nozzle is reduced for some reason so as to reduce the output density of a particular nozzle, the recording head shading technique adjusts the input image so that a gradation value in a portion corresponding to the affected nozzle is increased so as to have uniform image density in the output image.

As a nonejection complementary technique, if one nozzle is nonejecting, there are compensatory methods, such as substituting the ejection of nozzles on the both sides for the dot to be ejected by the nonejecting nozzle (adjacent complementing), or complementing data corresponding to the nonejecting nozzle with an ink dot of another color such as black (different-color complementing).

Although the aforementioned recording head shading and nonejection complementing methods are effective for improving recorded-image quality, these techniques are not without problems.

For example, if the amount of ink ejected from some nozzles in a recording head is decreased so as to reduce overall density, by increasing gray scale intensity in the affected portion, the recorded image will appear to have uniform image density (shading correction). However, if a nozzle with decreased ejection ability is printing in a region requiring full discharge capacity (duty factor of near 100%), no additional compensation above the nozzle's maximum decreased capacity is possible. Therefore, correction of this region is difficult to perform.

Similarly, in the adjacent complementing method, in which a nonejecting nozzle is complemented with an adjacent nozzle, if a portion adjacent to the nonejecting nozzle has a recording duty factor of 100% or close thereto, because the density of the adjacent portion cannot be further increased, the nozzles adjacent to the nonejecting nozzle will be unable to compensate.

In order to contend with such a problem, the inventors of the present invention have proposed a method for correcting a nonejecting nozzle, in which a nonejecting nozzle is corrected by a different recording head so as to minimize differences in lightness or color difference using a color different from the nonejecting nozzle. As to the recording head shading method, no countermeasure has yet been proposed.

Another compensation method involves virtually increasing the resolution (recording density) of a recording head in a relative principal scanning direction (transferring direction in a case that a recording medium is transferred with a recording head fixed) is virtually increased so as to enable the gray scale in the entire gradation regions to be corrected by enabling the recording medium to be recorded thereon by 100% or more as in a conventional method. However, according to this method, the amount of the data fed to the recording head is increased, resulting in a decrease in the per page recording rate. Furthermore, since the number of recording dots per unit area is increased, the ejecting frequency needs to be further increased in order to maintain the recording rate. Since the printing operation is generally performed substantially at the upper limit of the ejecting frequency, a per page recording rate is reduced.

SUMMARY OF THE INVENTION

It is an object of the present invention to provide a method for effectively performing shading correction and nonejecting nozzle complementing without reducing a per page recording rate.

The present invention has been made in order to achieve the above-mentioned object, in which when corrected data during shading correction and nonejection complementing exceeds a predetermined value, complementing is performed with a different color corresponding to data-amount exceeding the maximum value.

Specifically, in both the shading correction and nonejecting nozzle complementing methods, correction processing (same color correcting) is performed using a target head as a preliminary step, and correction processing (different-color correcting) is performed using a head with a different color other than the color of the target head as a subsequent step.

Also, the predetermined value is the maximum value capable of being recorded as data.

Further objects, features and advantages of the present invention will become apparent from the following description of the preferred embodiments with reference to the attached drawings.

DESCRIPTION OF THE PREFERRED EMBODIMENTS

Figure 1:
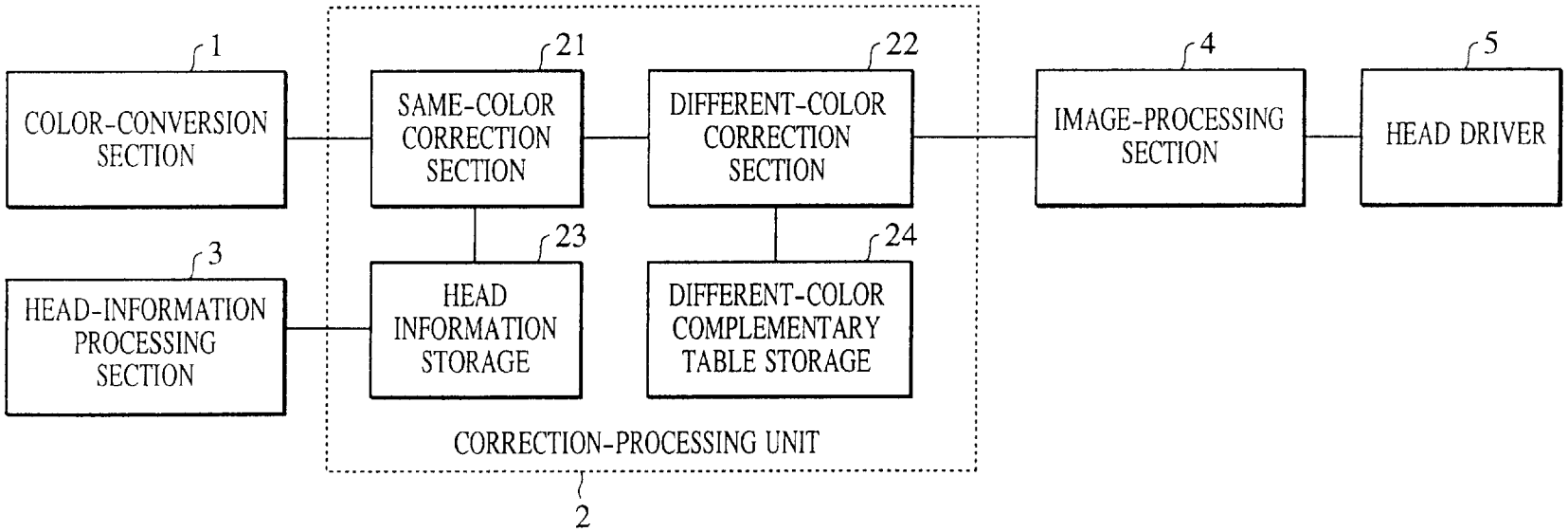
FIG. 1 is a block diagram showing data processing according to an embodiment of the present invention.

One noteworthy characteristic feature of the present invention is that when data corrected during shading correction and nonejecting nozzle complementing exceeds a maximum value capable of being recorded, the correction deficiency is complemented with a different color in an amount which represents the correction deficiency above the maximum value.

Specifically, in both the shading correction and nonejecting nozzle complementing methods, correction processing (same color correcting) is first performed using a target recording head of the same color, the correction processing (different-color correcting) is subsequently performed using a recording head with a different color other than the color of the target recording head.

Same color correction, the preliminary step, is a process which manipulates data such as 8-bit image data according to shading and nonejecting information. The shading information is an index showing the density of a print region corresponding to each nozzle. In the preliminary shading correction, the input image data is adjusted according to the shading information. As a specific technique, there may be a method in which an index is determined for each nozzle according to the shading information so as to make the product of the index and the image data be the corrected image data. Alternatively, the image data may be increased or decreased using a density conversion table established for the shading information. However, this method is not limited to these examples, and is generally applicable to any method which reduces nonuniformity in density by increasing or decreasing image data according to the shading information.

During the manipulation of image data through shading correction, a data amount is generally established to have an upper limit thereof corresponding to the maximum density capable of being recorded. The preliminary shading correction method according to the present invention does not necessarily address this specific point, because that correction is performed in the subsequent step involving the data amount which exceeds the upper limit of what is capable of being recorded.

The nonejecting nozzle information shows which nozzles cannot eject ink. Based on this information, a correction is performed as a substitute to the nonejecting nozzle by distributing the image data corresponding to the nonejecting nozzle to adjacent nozzles capable of ejecting ink (preliminary nonejecting nozzle correction). One embodiment of this technique could include distributing half of the nonejecting nozzle's image data to each of the adjacent nozzles which are capable of ejecting ink, and a method by which corresponding to both-side nozzles, the image data of the nonejecting nozzle portion is distributed by referring to image data of pixels corresponding to adjacent nozzles, up to the upper limit capable of being recorded. Generally, however, the important feature of preliminary nonejecting nozzle correction methods according to the present invention is that, while distributing nonejecting nozzle data to adjacent nozzles, if the pixel image data to be distributed exceeds the upper limit of the image data capable of being recorded, the exceeding data is not distributed to adjacent nozzles so as to save the data to the nonejecting nozzle portion. This feature differs from the aforementioned preliminary shading correction technique. Additionally, the upper limit of the image data capable of being recorded in the nonejecting nozzle portion is zero, i.e., no image can be recorded.

The different-color correction, which is the aforementioned subsequent processing, is the correction performed with a different color using a different head when a pixel exceeding the upper limit of the image data capable of being recorded is generated as a result of the same color correction performed within the same head at the preliminary step. The target color and the complementing color need not be identical, but it is of course preferable that the hues be as close as possible to each other. For example, for correcting cyan, black is preferable in a four-color printer of cyan C, magenta M, yellow Y, and black K. In a six-color printer of cyan C, magenta M, yellow Y, black K, light cyan LC, and light magenta LM, LC (light cyan, low-density cyan) may be preferable. Also, for correcting black, a processed black blended from C, M, and Y may be used.

Figure 5:
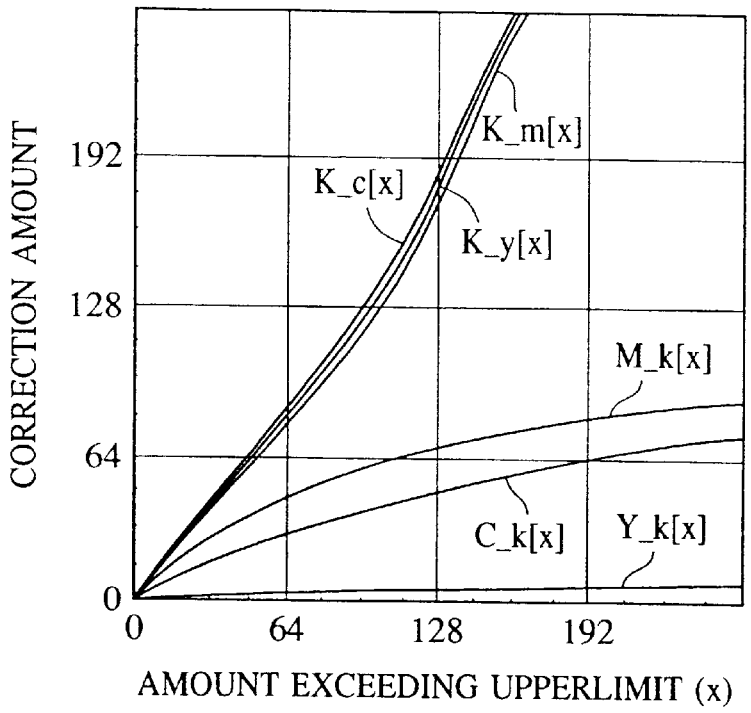
FIG. 5 is a graph for showing the relationship between a data amount of a target color to be corrected and a data amount of a complementing color.

For colors such as yellow, however, the correction should not use a different color because yellow is considerably light hued. Performing different color correction on a light color such as yellow must be determined by the entire system of the printer, so that it is not specifically limited. The amount of a complementing color is determined by the amount the target pixel data exceeds the upper limit of image data capable of being recorded. The relationship between the amount exceeding over the upper limit and the amount of the complementing color (different-color complementing table) is established in advance as shown in FIG. 5. As an example, the subsequent different-color complementing may be performed using the table in FIG. 5. As to the relationship between the target color and the corrected color established in the different-color complementing table, it is best when there is no color difference, however, that is not always practical in a four or six-color printer. Accordingly, it is preferable to use a different-color complementing table capable of minimizing the color and contrast difference.

In such a manner, on the different-color portion, the processing can be collectively performed without distinguishing the head shading correction from the nonejecting nozzle correction, enabling the process circuit to be simplified and speeded up.

The aforementioned shading and nonejecting nozzle information do not have to be corrected at any one particular time. For example, in a shipping stage of the recording head from a factory, head characteristics can be measured and stored in a memory mounted on the recording head, and the correction may be performed by accessing this memory. Alternatively, the shading and nonejecting nozzle information may be obtained by printing a test chart and reading it with a scanner. Furthermore, a series of operations for updating the shading and nonejecting nozzle information can be automatically performed using a printer having a scanner built therein. The present invention is not limited thereto. Since the state of the recording head may significantly change from time to time, it is preferable that the printer system be capable of updating the shading and nonejecting nozzle information on demand.

An embodiment according to the present invention will be described below in detail with reference to the drawings.

According to the embodiment, gray-scale images are output using a side-shooter type thermal inkjet recording head. The resolution (nozzle density) of the recording head is 600 dpi, and the head has a length of about 293 mm with 6912 nozzles, and the ejection amount each nozzle is about 8 pl. A printer having the four longitudinal multi-heads for cyan C, magenta M, yellow Y, and black K is used so as to output images. The resolution of the output image is 600×600 dpi, and a one-pass recording system is adopted in which a recording medium passes through relative to the fixed head.

In the ink used for C, M, Y, and K, various additives are used to substantially equalize the physical properties, namely, viscosity: 1.8 cps and surface tension: 39 dyn/cm. The driving conditions of the recording head are frequency: 8 kHz, voltage: 10 V, and applied pulse width: 0.8 $\mu$s. Under these conditions, about 8 pl of ink droplets are ejected at a speed of about 15 m/s.

FIG. 1 is a block diagram showing data processing according to the embodiment. Referring to the drawing, a color-conversion section 1 is for performing color-conversion that converts 8-bit input image data for each of R, G, and B into 8-bit image data for each of four colors C, M, Y, and K, and $\gamma$ conversion and enlarging or contracting of the image data are performed on demand therein.

In a correction-processing unit 2 embodying the present invention, correction is performed based on shading and nonejecting nozzle information. The correction-processing unit 2 comprises a same-color correction section 21 as a preliminary step and a different-color correction section 22. The shading and nonejecting nozzle information necessary for the same-color correction at the preliminary step are stored in head information storage 23.

The different-color complementary table necessary for the different-color correction at the subsequent section is stored in different-color complementary table storage 24. A head-information processing section 3 reads a test chart output on demand so as to prepare the shading information and non-ejecting nozzle information by processing the data for updates the information stored in the head information storage 23. The image processing section 4 binarizes the data corrected by the correction-processing section 2 so as to generate data corresponding to each nozzle of the recording head. The head driver 5 drives the recording element (ejecting element) corresponding to each nozzle on the basis of the data fed by the image processing section 4. The bit map data is fed to a head driver 5 so as to output images by driving the recording head according to the bit map data.

Figure 2:
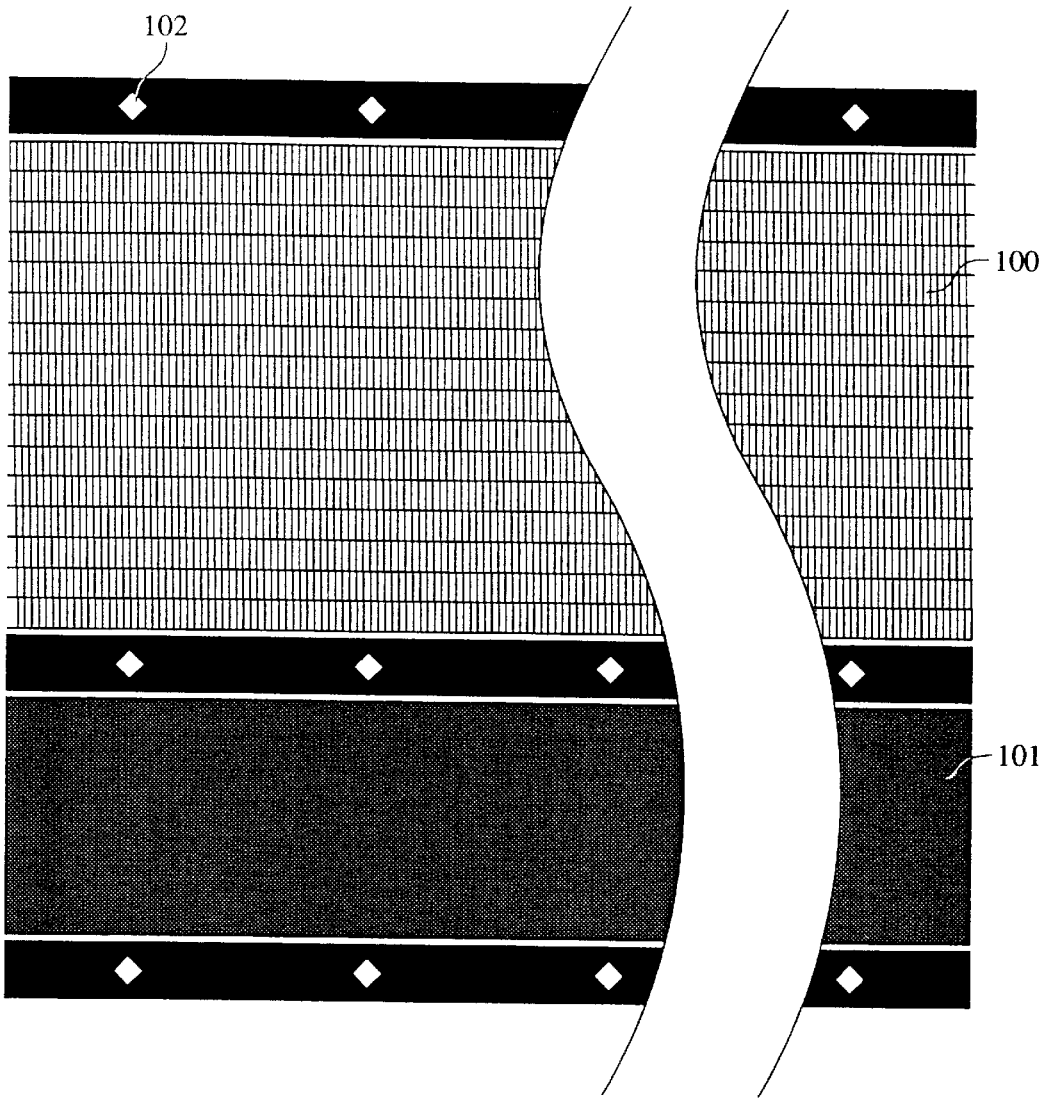
FIG. 2 is a test chart for obtaining nonejecting nozzle and shading information.

When printing images, first, a test chart shown in FIG. 2 is printed so as to process it in the head-information processing section 3 for updating the information stored in the head information storage 23. The test chart used here comprises a nonejecting-nozzle detection pattern 100 and a shading pattern 101, and the chart is output for each color. In the nonejecting-nozzle detection pattern 100, there are 16 columns of lines, each line having a length of 64 pixels recorded by one nozzle, and each column is shifted by a length equivalent to one nozzle. That is, each column has lines equivalent to 448 nozzles, which are stacked up by 16 columns. The shading pattern 101 has a recording duty factor of 50% and a size of 7168×512 pixels. The shading pattern 101 is also provided with markers 102 for corresponding to each nozzle.

These patterns are read with a scanner having an optical resolution of 1200 dpi so as to detect a nonejecting nozzle and measure density distribution. Specific methods for detecting a nonejecting nozzle and measuring density distribution are shown as follows.

The marker 102 is provided for identifying the nozzle number, and is arranged at intervals of 512 nozzles, making 14 markers in total. The image data read with the scanner is divided according to color and converted into gray scale data, which reflects color density. From the gray scale data, the position of the marker is read and rotation and enlarging or contracting are appropriately performed so as to correspond to the pixels equivalent to 600 dpi for converting the data into the data correlated with the nozzle position.

Figure 3:
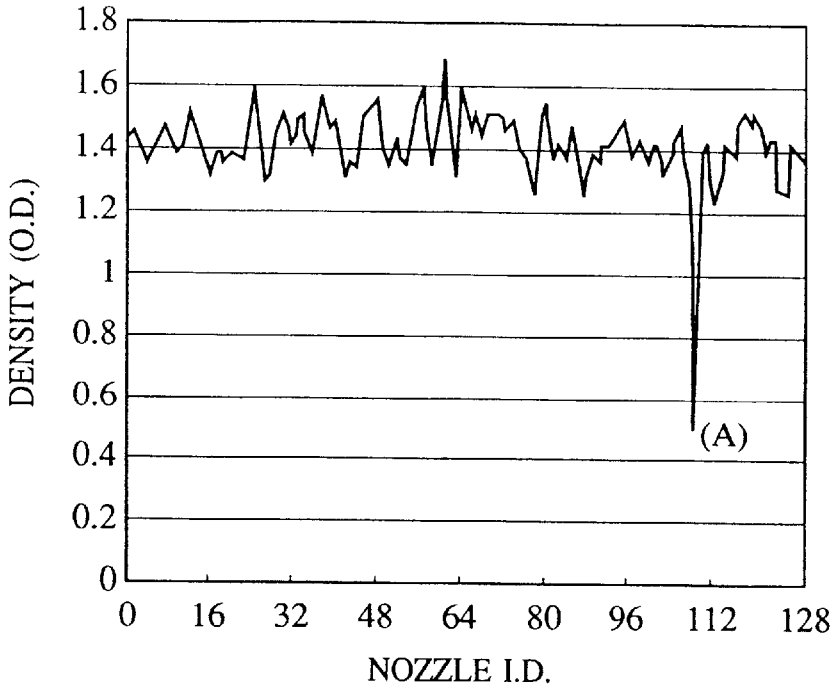
FIG. 3 is a graph for showing a cyan density distribution according to an embodiment.
Figure 4:
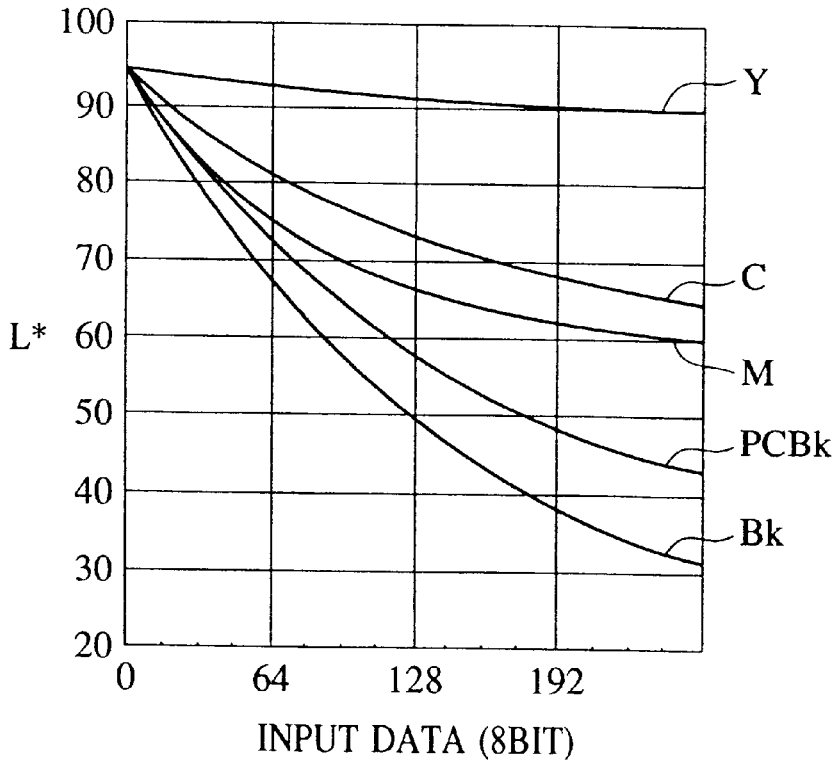
FIG. 4 is a graph for showing the relationship between a data amount and its lightness for each color.

FIG. 3 shows a recording density corresponding to each nozzle, where nonuniformity in the density can be recognize along the arranging direction of nozzles. Portions with extremely low density indicate non-recorded portions. FIG. 4 shows the relationship between the amount of the gray scale shown by recorded data corresponding to each color and the lightness of recorded images. The detection of a nonejecting nozzle is performed using the nonejecting-nozzle detection pattern 100 after performing the suitable rotation and enlarging or contracting as described above. From each column of the pattern, a portion equivalent to 7168×50 pixels is cut off, and furthermore, the determination is made for each recording position corresponding to one pixel. If the density of this portion is substantially the same as that of a nonrecorded portion, the corresponding nozzle is nonejecting. Therefore, a nozzle with a large kink is determined to be nonejecting.

On the other hand, the shading information for each nozzle is determined as follows.

First, the density distribution for each nozzle is calculated, wherein the central section of the shading pattern 101 with a recording duty factor of 50%, which is equivalent to 7168×400 pixels, is cut off, and 400 pixels for each nozzle are averaged to determine the density distribution.

When the color of the recording head is c; the density of the nozzle number i is dens[c][i]; and the average density of the entire nozzles is ave[c], the shading data she[c][i] is set to be:

$$she[c][i]=(dens[c][i]-ave[c])/ave[c].$$

That is, this value shows the density degree recorded by each nozzle. In addition, the average density (ave[c]) calculation should preferably exclude nonejecting portions therefrom. For a sample of 128 pixels, an example is shown in FIG. 3. In the drawing, symbol (A) shows the nonejecting nozzle portion detected by the above-mentioned nonejecting-nozzle detection procedure. The new nonejecting nozzle information and the shading information are stored again within the head information storage 23.

In addition, according to this embodiment, the arithmetic calculation is performed on the unprocessed density data for each nozzle read with the scanner, so as to provide the shading data; alternatively, the shading data may be prepared from the density distribution read with the scanner after suitable processing is performed on the density distribution.

In the different-color correction, the relationship between a target color to be corrected and a complementing color to be added is determined from the relationship between the data amount for each color and the lightness at that time.

The relationship between a data amount and lightness for each color according to the embodiment is shown in FIG. 4. The data amount of a complementing color is established so as to equalize the lightness in the data amount of a target color to be corrected and the lightness of the complementing color to be added. This information is shown in FIG. 5.

According to this embodiment, cyan and magenta are complemented with black and black is complemented with processed black blended from cyan, magenta, and yellow. As for yellow, because yellow is usually very light, the different-color correction is not performed thereon. The different color correction information is stored in different color-complementary storage 24.

Figure 6:
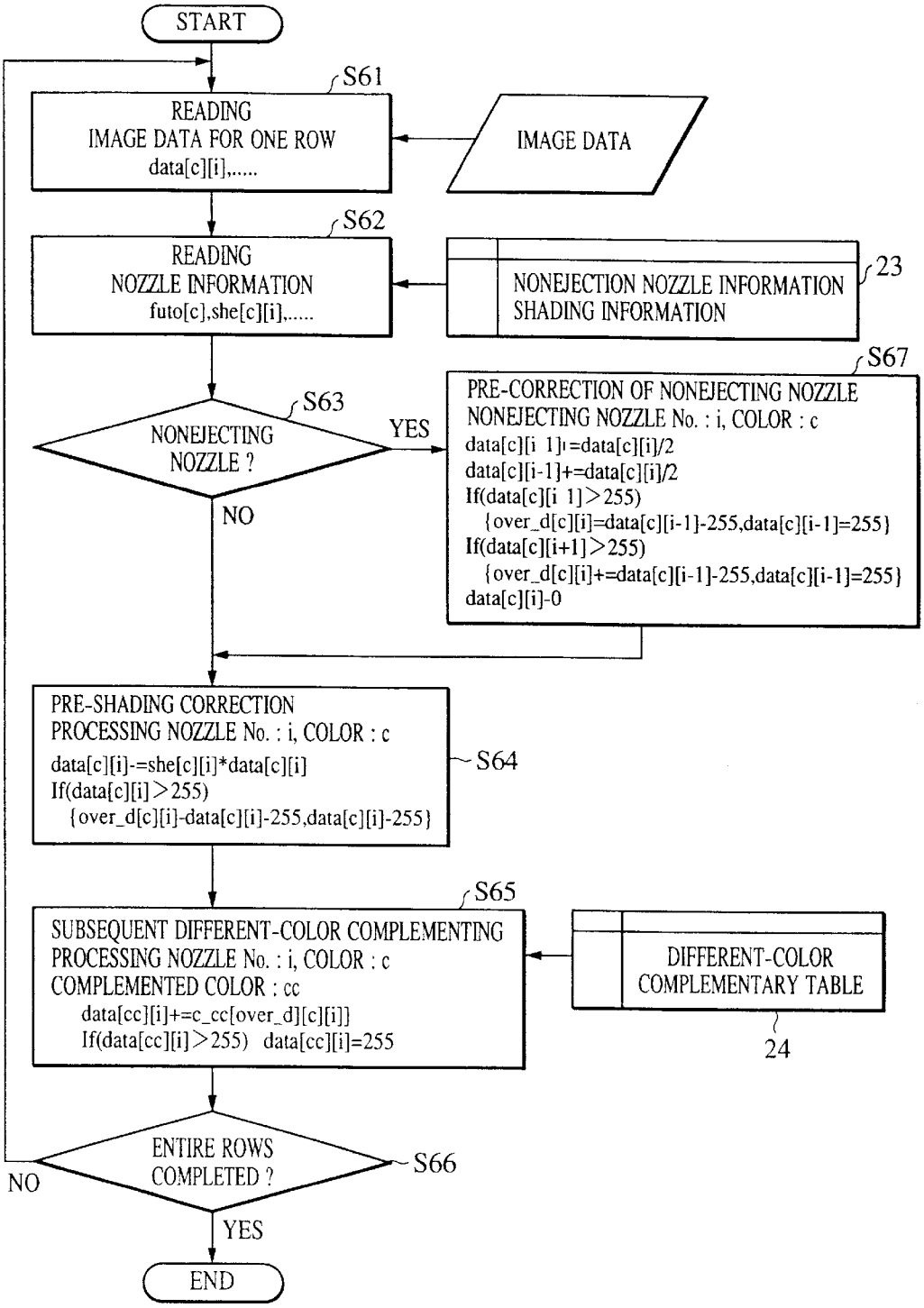
FIG. 6 is a flow chart for illustrating correction processing according to an embodiment.

Using the values in the head information storage 23 and the different color complementary table storage 24, correction processing is performed in the correction-processing unit 2. The correction processing will be described with reference to the flow chart in FIG. 6. In this process, the image data processed in the color-conversion section 1 is sequentially processed for each row (S61). Each row corresponds to the width of one recording head, and the image data read therein can be simply matched with the nozzle for actually recording the data. Next, a nonejecting nozzle is detected using the nozzle information called from head information storage 23 (S62, S63). If a nonejecting nozzle exists, the preliminary nonejecting-nozzle correction is performed on the pixel corresponding to the nonejecting nozzle, according to the following method (S67). When the nonejecting nozzle number is i and the color thereof is c, the image data corresponding to the nozzle is denoted as data[c][i]. If the half data amount data[c][i]/2 is distributed to each side of the nozzle, and the data consequently exceeds a predetermined value, it is temporarily stored as data over_d[c][i] to be used in the subsequent different-color correction section. In addition, according to the embodiment, the predetermined value is a maximum value capable of being recorded, i.e., a possible maximum value of multiple-valued data to be recorded (255: 8-bit according to the embodiment).

After completion of the preliminary nonejecting-nozzle correction, the preliminary shading correction is performed (S64). This processing is simply performed as a linear correction according to the shading data she[c][i] of a target nozzle. Wherein a proportional coefficient $\alpha$ and the corrected result data'[c][i] are shown in the following equations.

$$\alpha = (1\ she[c][i]) \text{ and}$$

$$data'[c][i] = \alpha\ data[c][i] = data[c][i]\ she[c][i] \times data[c][i].$$

As a result of the correction in such a manner, if the data exceeds a predetermined value, it is temporarily stored as data over_d[c][i] to be used in the subsequent different-color correction section. In order to distinguish between pre-correction and post-correction, data[c][i] and data'[c][i] are separately denoted; however, it is not necessary to distinguish them in practice.

After completion of the preliminary same-color correction, the subsequent different-color correction is performed (S65). In such a manner, the different-color correction can complement the correction deficiency of the complementary processing with the same-color correction so as to form excellent images. The different-color correction adds a different color to the value over d[c][i] exceeding the maximum value capable of being recorded according to the different-color complementary table stored in the table storage 24 (which itself is calculated in the preliminary process). According to the embodiment different-color complementary tables C_k[x], M_k[x] are used when cyan or magenta are complemented with black and different color complementary tables K_c[x], K_m[x], K_y[x] are used for when black is complemented with processed black (shown in FIG. 5).

After completion of the preliminary same-color correction and the subsequent different-color correction, binarization is performed in the image processing section 4. According to this embodiment, the binarization is performed according to a general error diffusion method. The bit map data thus obtained are fed to the head driver 5 so as to output corrected images.

The images thus obtained are excellent with inconspicuous streaks of nonejecting portions and with streaks and nonuniformity largely reduced.

As described above, according to the present invention, when the data corrected during the shading correction and nonejecting nozzle exceeds a predetermined value such as the maximum value capable of being recorded, the correction is complemented with a different color corresponding to an exceeding data amount over the maximum value, so that various kinds of corrections can be effectively performed without reducing the per-page recording rate. Also, as a result, there is an advantage that the yield of the recording head is increased, in practice.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the claims. The scope of the following claims is to be accorded the broadest interpretation so as to encompass all such modifications and equivalent structures and functions.

What is claimed is:

1. An image correction method in an inkjet recording apparatus for recording images by ejecting ink on a recording medium using a recording head having a plurality of nozzles for ejecting ink arranged on the recording head, the image correction method comprising the step of correcting images by referring to recording characteristic information relating to nonejecting nozzles of the recording head and nonuniformity in recorded density, wherein the step of correcting images comprises a same-color correction process for performing correction with the same recording head as a target recording head to be corrected and a different-color correction process for performing correction with a recording head different from the target recording head, and wherein when the data corrected by the same-color correction exceeds a predetermined value, the different-color correction process is performed with the different color corresponding to the amount exceeding the predetermined value.

2. A method according to claim 1, wherein the same-color correction process comprises a same-color nonejecting-nozzle correction process for performing correction on a nonejecting nozzle and a same-color shading correction process for correcting density nonuniformity, and wherein the same-color nonejecting-nozzle correction process distributes corresponding pixel data to adjacent pixels in nozzle-row directions within a range not exceeding the predetermined value, and a residual data amount, which is not distributed, is processed as excessive data of a target pixel.

3. A method according to claim 1, wherein the same-color correction process comprises a same-color nonejecting-nozzle correction process for performing correction on a nonejecting nozzle and a same-color shading correction process for correcting density nonuniformity, and wherein the same-color shading correction process increases or decreases corresponding pixel data based on recording characteristic information established in advance for each nozzle, and an exceeding value over the predetermined value is processed as excessive data of a target pixel.

4. A method according to claim 1, wherein the different-color correction process adds different-color data to excessive data of a target pixel according to a different-color complementary table established in advance, and wherein the different-color complementary table is established so as to substantially equalize the lightness of a complementing color and its data-amount to the lightness of a target color data-amount.

5. A method according to claim 1, wherein the different-color correction process adds different-color data to excessive data of a target pixel according to a different-color complementary table established in advance, and wherein the different-color complementary table is established so as to substantially minimize the color difference between a target color data-amount and a color data-amount complemented thereto.

6. A method according to claim 1, wherein the predetermined value is a maximum data value capable of being recorded.

* * * * *

UNITED STATES PATENT AND TRADEMARK OFFICE

CERTIFICATE OF CORRECTION

PATENT NO. : 6,702,426 B2
DATED : March 9, 2004
INVENTOR(S) : Masataka Yashima

It is certified that error appears in the above-identified patent and that said Letters Patent is hereby corrected as shown below:

Title page,
Item [57], ABSTRACT,
Line 2, "kink" should read -- ink --.

Signed and Sealed this

Fourteenth Day of December, 2004

JON W. DUDAS
*Director of the United States Patent and Trademark Office*